US006932533B1

(12) United States Patent
Chen

(10) Patent No.: US 6,932,533 B1
(45) Date of Patent: Aug. 23, 2005

(54) COSMETIC CONTAINER FOR CONTROLLING POWDER FLOW RATE

(76) Inventor: Lin Li Chen, 14F-13, No. 130, Szu Wei Rd., Hsin Chu City (TW)

( * ) Notice: Subject to any disclaimer, the term of this patent is extended or adjusted under 35 U.S.C. 154(b) by 97 days.

(21) Appl. No.: 10/775,093

(22) Filed: Feb. 11, 2004

(51) Int. Cl.[7] ..... A46B 11/04; A47L 13/22

(52) U.S. Cl. ..... 401/281; 401/124; 401/133; 401/280

(58) Field of Search ..... 401/82, 123, 124, 401/133, 269, 270, 280, 281; 132/293, 298–301, 132/304–307

(56) References Cited

U.S. PATENT DOCUMENTS 3,100,315 A * 8/1963 Laxalt ..... 132/289
4,652,162 A * 3/1987 Ladd et al. ..... 401/123
4,671,690 A * 6/1987 Ladd et al. ..... 401/281
4,728,211 A * 3/1988 Ladd, Jr. ..... 401/123
6,457,891 B1 * 10/2002 Bredacts ..... 401/281

* cited by examiner

*Primary Examiner*—Tuan Nguyen
(74) *Attorney, Agent, or Firm*—Rosenberg, Klein & Lee

(57) ABSTRACT

A cosmetic container has a container body, a rotating body, a brush, a stopper, a container cover and a brush cover. The container body is for receiving powder and the container has two curved guiding slots and two outlets. The rotating body is rotatably connected to the bottom of the container body. The brush is arranged in a top of the rotating body. The stopper is stuffed in the opening of the container body and the container cover is separately connected to a top of the container body. The brush cover is separately connected to the bottom of the container body. The cosmetic container controls flow rate of powder from the container body.

4 Claims, 7 Drawing Sheets

COSMETIC CONTAINER FOR CONTROLLING POWDER FLOW RATE

BACKGROUND OF THE INVENTION (1) Field of the Invention

The present invention relates to a cosmetic container, more particularly to a cosmetic container for controlling powder flow rate.

(2) Description of the Related Art

Cosmetics are increasingly important at formal occasions, to the point where they have become basic manners.

Referring to FIGS. 1–3, a conventional cosmetic container has a container body 100*a*, a housing 200*a*, a rotating body 300*a* and a brush 400*a*.

The container body 100*a* is for receiving powder. The housing 200*a* is connected to an opening of the container body 100*a*; moreover, the housing 200*a* has a plurality of penetrating holes 210*a* formed in a top thereof. The rotating body 300*a* has a plurality of through holes 310*a* formed in a top thereof and the plural through holes 310*a* correspond to the plural penetrating holes 210*a* of the housing 200*a*. The brush 400*a* is arranged on the rotating body 300*a*.

The rotating body 300*a* is rotated until the through holes 310*a* of the rotating body 300*a* completely coincide with the penetrating holes 210*a* of the housing 200*a*. Powder in the container body 100*a* then flows out from the container body 100*a*.

However, powder flow rate of the conventional cosmetic container is not controlled. Unnecessary powder flows out, which wastes too much powder.

Therefore, according to above descriptions, there are some issues of inconvenience, which need to be improved.

SUMMARY OF THE INVENTION

The object of the present invention provides a cosmetic container for controlling powder flow rate to avoid wasting powder.

In order to achieve the object, the cosmetic container has a container body, a rotating body, a brush, a stopper, a container cover and a brush cover. The container body is for receiving powder and the container has two curved guiding slots and two outlets. The rotating body is rotatably connected to the bottom of the container body. The rotating body has two through holes and two protruding blocks. The two through holes correspond to the two outlets of the container body. The brush is arranged on a top of the rotating body. The stopper is stuffed in the opening of the container body and the container cover is separately connected to a top of the container body. The brush cover is separately connected to the bottom of the container body. As a result, the cosmetic container controls flow rate so that powder in the container body flows from the two outlets of the container body to the two through holes of the rotating body.

It is to be understood that both the foregoing general description and the following detailed description are exemplary, and are intended to provide further explanation of the invention as claimed.

Other advantages and features of the invention will be apparent from the following description, drawings and claims.

BRIEF DESCRIPTION OF THE DRAWINGS

These and other features, aspects, and advantages of the present invention will become better understood with regard to the following description, appended claims, and accompanying drawings, where:

DETAILED DESCRIPTION OF PREFERRED EMBODIMENTS

Figure 1:
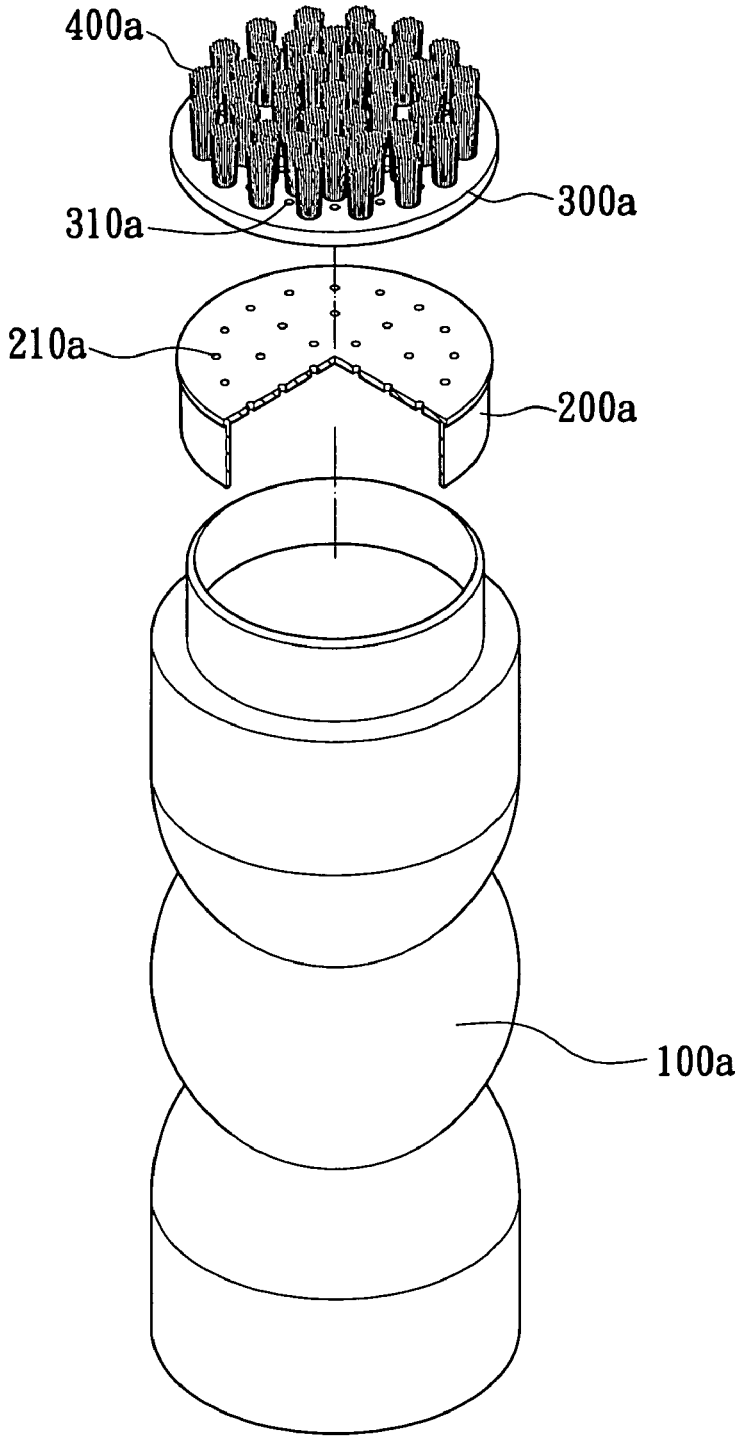
FIG. 1 PRIOR ART
FIG. 1 is an exploded perspective view of a conventional cosmetic container.
Figure 2:
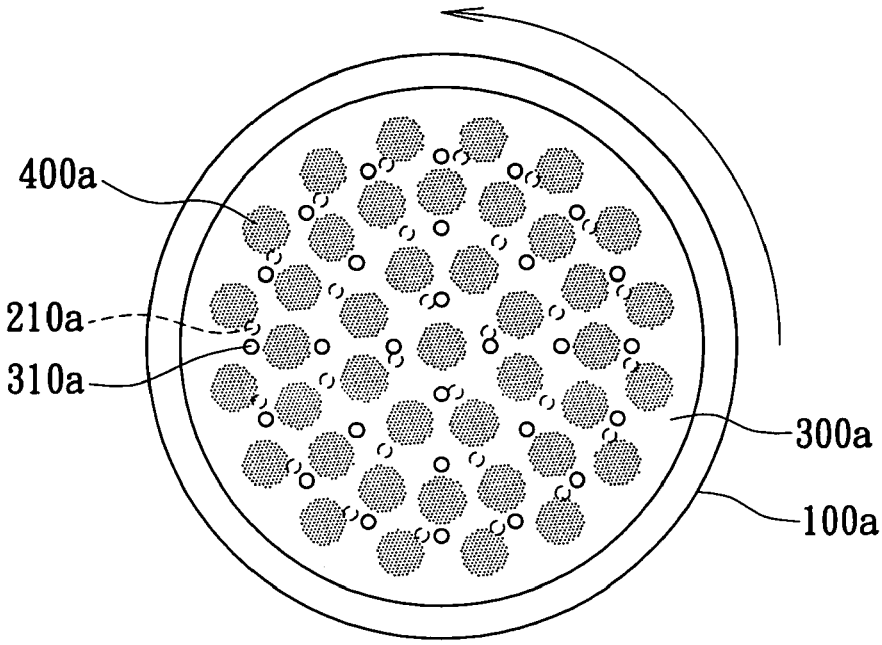
FIG. 2 PRIOR ART
FIG. 2 is a schematic view that shows the through holes 310*a* of the rotating body 300*a* not completely coinciding with the penetrating holes 210*a* of the housing 200*a* in the prior art.
Figure 3:
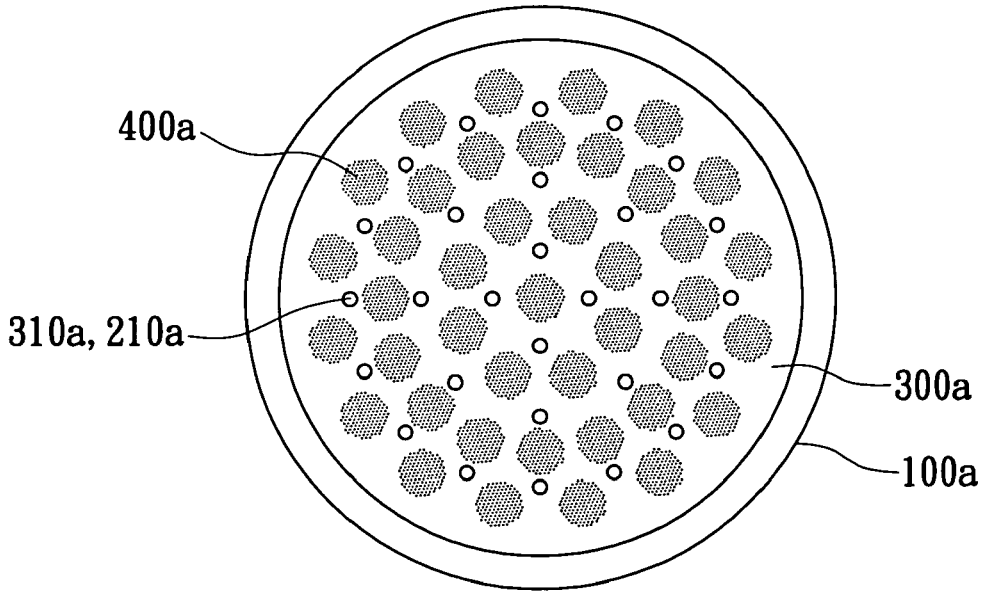
FIG. 3 PRIOR ART
FIG. 3 is a schematic view that shows the through holes 310*a* of the rotating body 300*a* completely coinciding with the penetrating holes 210*a* of the housing 200*a* in the prior art.
Figure 4:
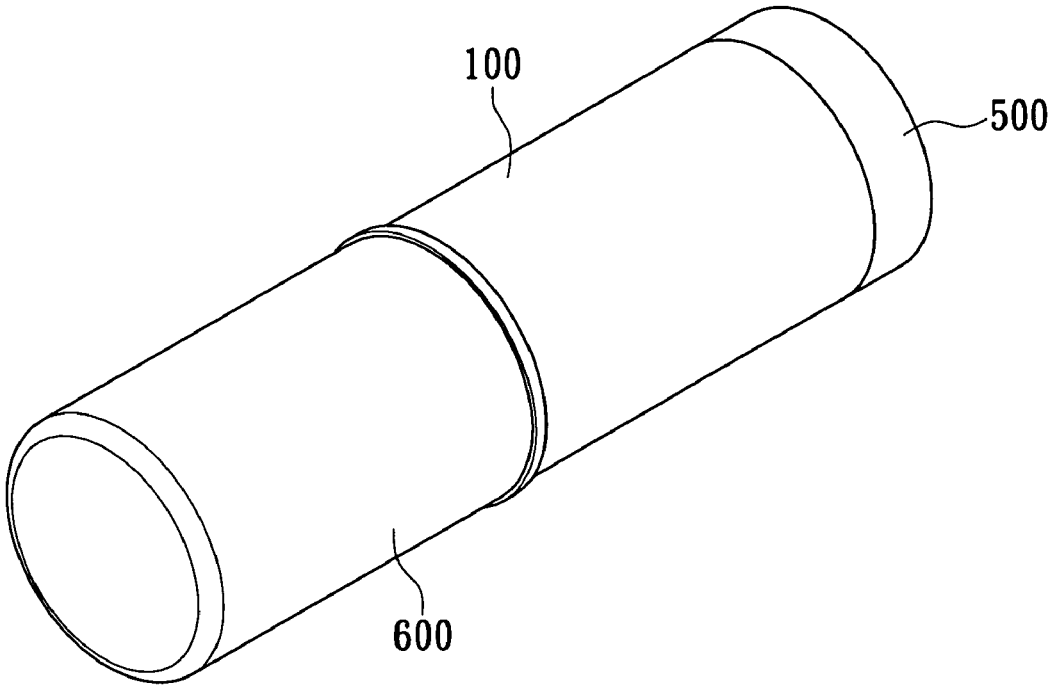
FIG. 4 is a perspective view of a cosmetic container in accordance with the present invention.
Figure 5:
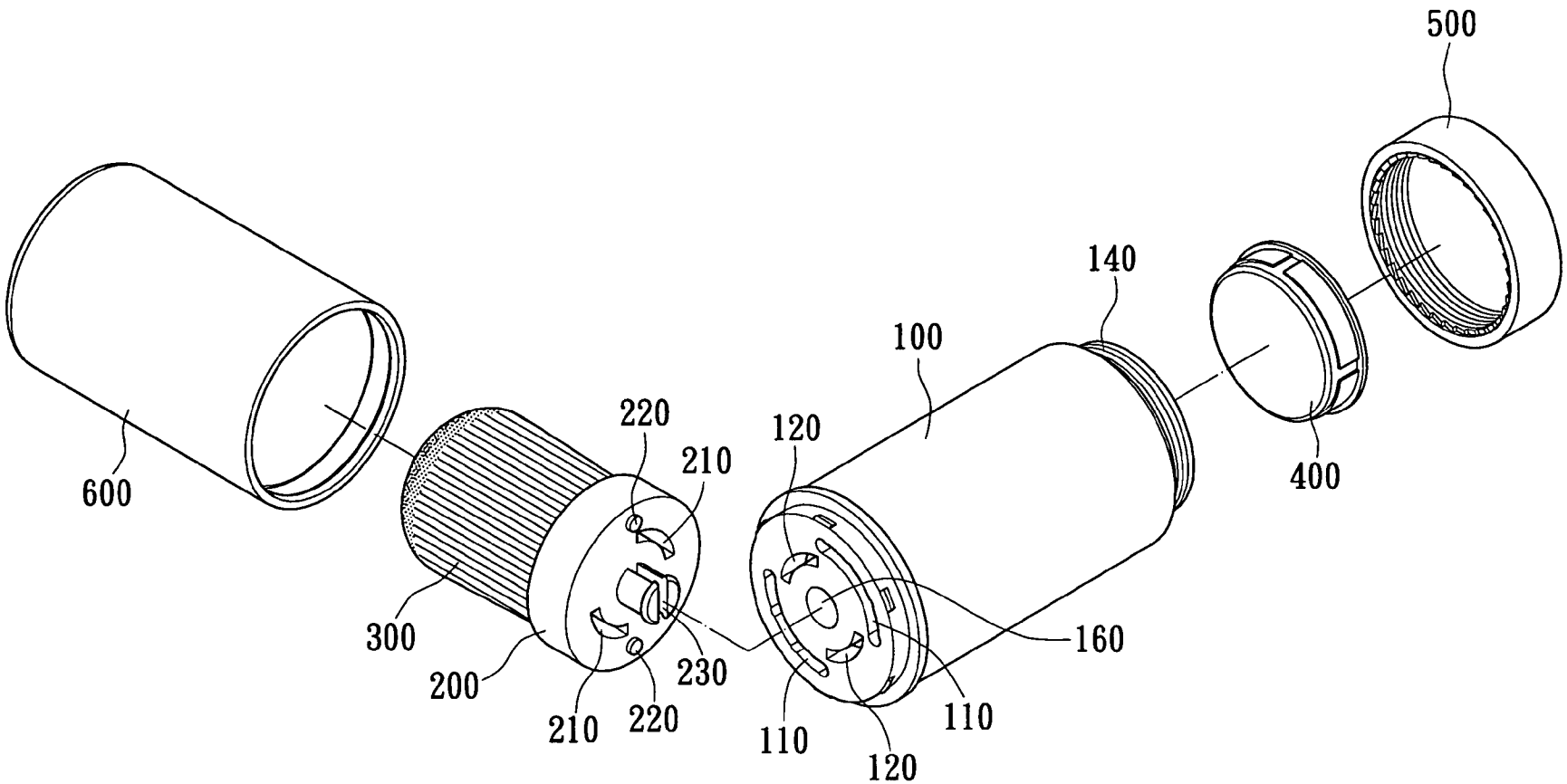
FIG. 5 is an exploded perspective view of the cosmetic container in accordance with the present invention.
Figure 6:
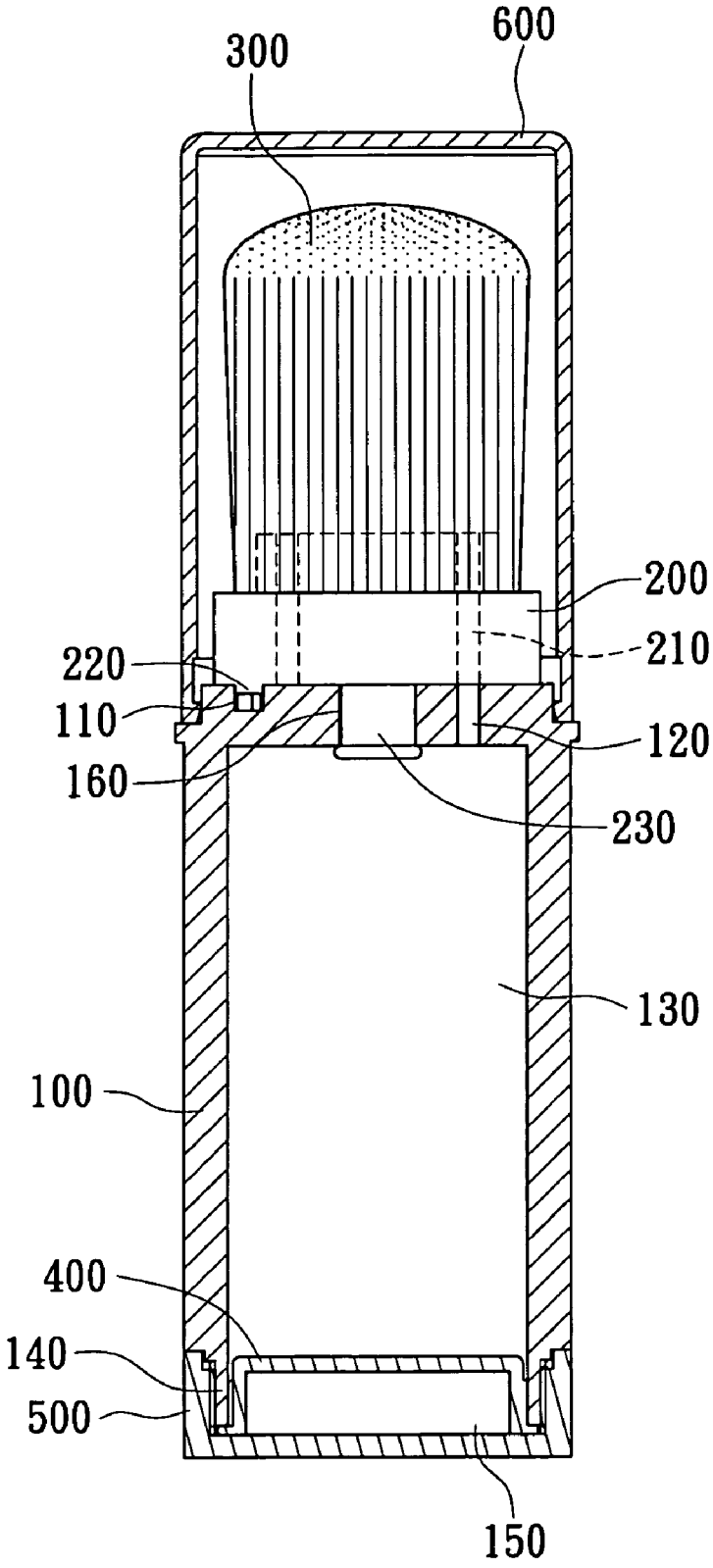
FIG. 6 is a cross-sectional view of the cosmetic container in accordance with the present invention.

Referring to FIGS. 4–9, the present invention provides a cosmetic container for controlling powder flow rate. The cosmetic container has a container body 100, a rotating body 200, a brush 300, a stopper 400, a container cover 500 and a brush cover 600.

The container body 100 is for receiving powder, and the container body 100 has two curved guiding slots 110, two outlets 120, a receiving space 130, a circular connecting portion 140, an opening 150 and a holding hole 160. The two curved guiding slots 110 are symmetrically formed in a bottom of the container body 100. The two outlets 120 are symmetrically formed between the two curved guiding slots 110. The receiving space 130 is formed in the container body 100. The circular connecting portion 140 is formed around a periphery of a top of the container body 100. The opening 150 is defined by the circular connecting portion 140 and communicates with the receiving space 130. The holding hole 160 is formed in the bottom of the container body 100.

The rotating body 200 is rotatably connected to the bottom of the container body 100. The rotating body 200 has two through holes 210, two protruding blocks 220 and a hook 230. The two through holes 210 are respectively in correspondence with the two outlets 120 of the container body 100 formed at a bottom of the rotating body 200. The two protruding blocks 220 are respectively in correspondence with two different ends of the two curved guiding slots 110 and are extended from the bottom of the rotating body 200. The two protruding blocks 220 are respectively slidably received in the two curved guiding slots 110 of the container body 100. The hook 230 is in correspondence with the holding hole 160 of the container body 100 and is formed at the bottom of the rotating body 200. The hook 230 is inserted into the holding hole 160 to connect with the container body 100.

The brush 300 is arranged on a top of the rotating body 200. The stopper 400 is stuffed in the opening 150 of the container body 100 and the container cover 500 is separately connected to the circular connecting portion 140 of the container body 100. The brush cover 600 is separately connected to the bottom of the container body 100 for receiving the brush 300.

Figure 7:
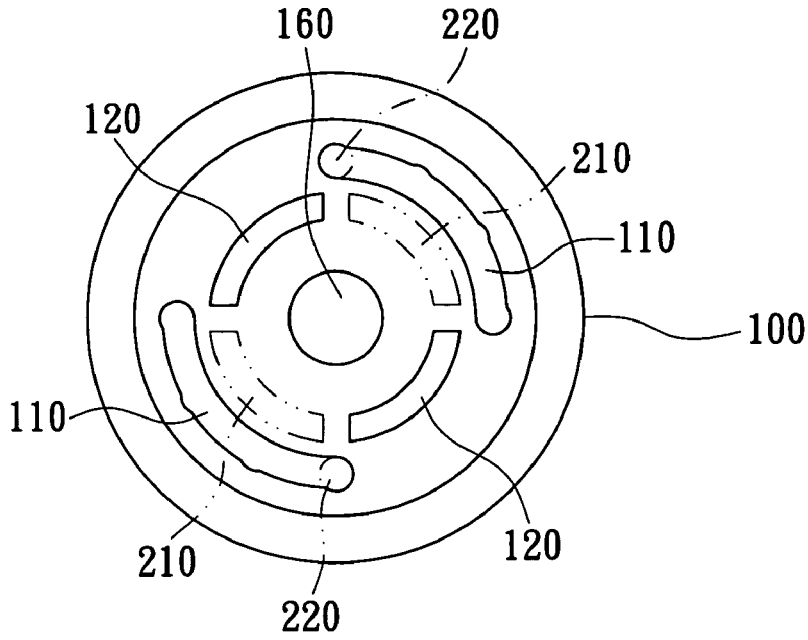
FIG. 7 is a schematic view that shows the two outlets 120 of the container body 100 not completely coinciding with the two through holes 210 of the rotating body 200.

Referring to FIG. 7, the two outlets 120 of the container body 100 don't completely coincide with the two through holes 210 of the rotating body 200. Powder in the container body 100 doesn't flow out.

Figure 8:
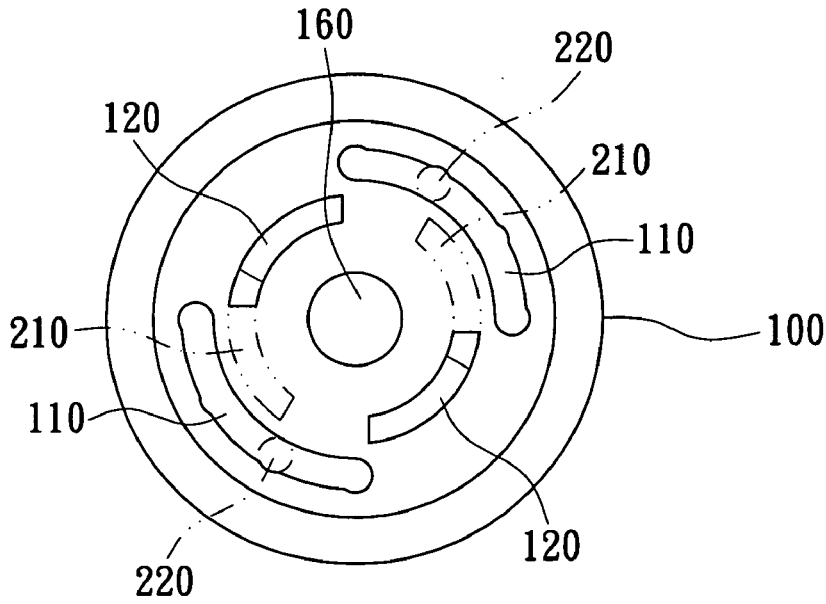
FIG. 8 is a schematic view that shows the two outlets 120 of the container body 100 partially coinciding with the two through holes 210 of the rotating body 200.

Referring to FIG. 8, when the rotating body 200 is rotated, the two outlets 120 of the container body 100 partially coincide with the two through holes 210 of the rotating body 200. Powder in the container body 100 partially flows out.

Figure 9:
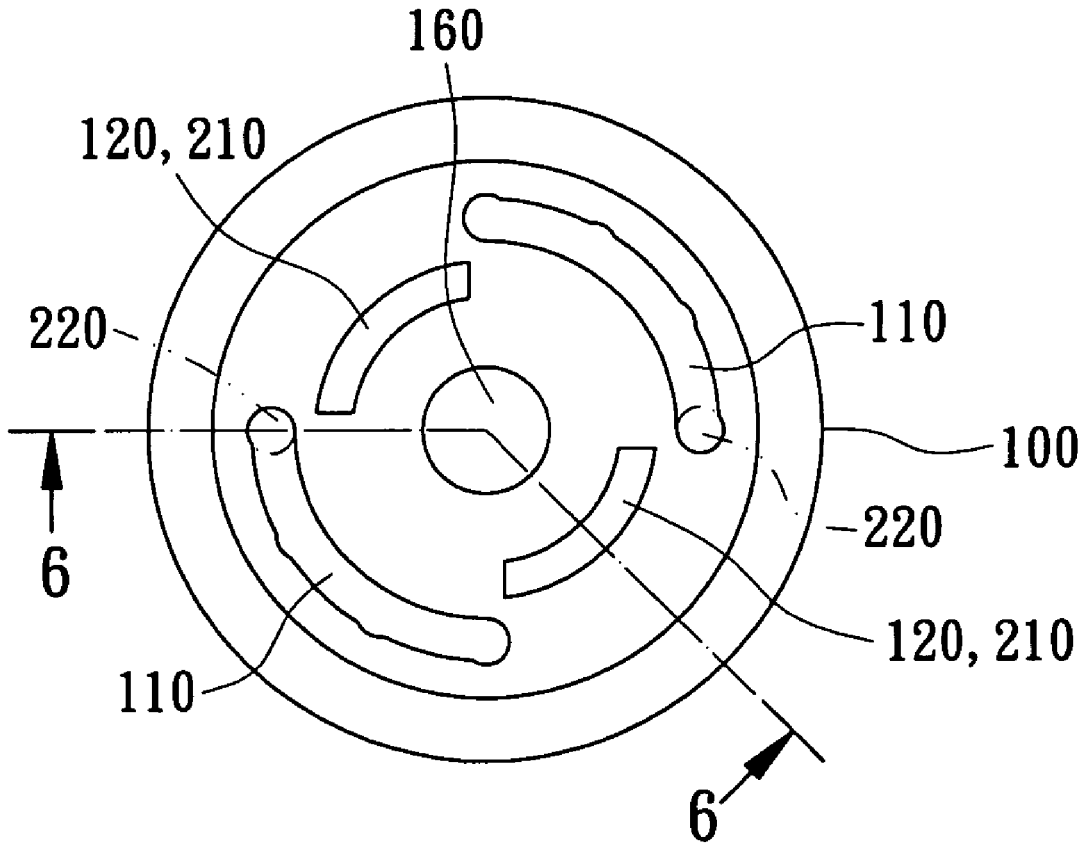
FIG. 9 is a schematic view that shows the two outlets 120 of the container body 100 completely coinciding with the two through holes 210 of the rotating body 200.

Referring to FIG. 9, the rotating body 200 is further rotated, and the two outlets 120 of the container body 100 completely coincide with the two through holes 210 of the rotating body 200. Powder in the container body 100 flows out at the maximum flow rate.

The cosmetic container thus controls flow rate such that powder in the container body 100 flows from the two outlets 120 of the container body 100 to the two through holes 210 of the rotating body 200.

According to above description, the present invention has the following advantages:

(1) When not enough powder is in the container body 100, the stopper 400 is removed from the container cover 500 to add powder therein.

(2) The cosmetic container controls powder flow rate so as to avoid wasting powder.

Therefore, the foregoing is considered as illustrative only of the principles of the invention. Further, since in the art, it is not desired to limit the invention to the exact construction and operation show and described, all suitable modifications and equivalents may be resorted to, falling within the scope of the invention.

What is claimed is:

1. A cosmetic container for controlling powder flow rate, comprising:

a container body for receiving powder, the container body having two curved guiding slots symmetrically formed in a bottom thereof and two outlets symmetrically formed between the two curved guiding slots;

a rotating body rotatably connecting to the bottom of the container body, the rotating body having two through holes respectively in correspondence with the two outlets of the container body formed in the bottom thereof, two protruding blocks respectively in correspondence with two different ends of the two curved guiding slots, the two protruding blocks extending from the bottom of the rotating body; and, a brush arranged on a top of the rotating body;

wherein the two protruding blocks are respectively and slidably received in the two curved guiding slots of the container body, so as to control powder flow rate of powder from the two outlets in the container body to the two through holes of the rotating body by rotating the rotating body.

2. The cosmetic container as claimed in claim 1, wherein the container body has a receiving space formed therein, a circular connecting portion formed around a periphery of a top of the container body, an opening defined by the circular connecting portion and communicating with the receiving space and a holding hole formed in the bottom of the container body, wherein the rotating body has a hook in correspondence with the holding hole of the container body formed in the bottom thereof, and wherein the hook is inserted into the holding hole for connection with the container body.

3. The cosmetic container as claimed in claim 2, further comprising a stopper stuffed in the opening of the container body and a container cover separately connecting to the circular connecting portion of the container body.

4. The cosmetic container as claimed in claim 1, further comprising a brush cover separately connecting to the bottom of the container body for receiving the brush.

* * * * *